US005178047A

United States Patent [19]

Arnold et al.

[11] Patent Number: 5,178,047

[45] Date of Patent: Jan. 12, 1993

[54] REVERSIBLE RATCHET WRENCH

[75] Inventors: Robert L. Arnold, Leola; Richard P. Folkenroth, Windsor; James A. VanLenten, Lancaster; Kenneth J. Taggart, Columbia, all of Pa.; James Gurzenski, Long Meadow, Mass.

[73] Assignee: EASCO Hand Tools, Inc., Lancaster, Pa.

[21] Appl. No.: 742,845

[22] Filed: Aug. 8, 1991

[51] Int. Cl.[5] ..... B25B 13/46; B25B 13/48; B25B 13/36; B25B 13/06

[52] U.S. Cl. ..... 81/63.2; 81/63; 81/62; 81/60

[58] Field of Search ..... 81/60, 61, 62, 63, 63.2, 81/63.1

[56] References Cited

U.S. PATENT DOCUMENTS

| | | | |
|---|---|---|---|
| 2,764,048 | 9/1956 | Thompson | 81/60 |
| 3,078,973 | 2/1963 | Kilness | 81/63.2 |
| 3,575,069 | 4/1971 | White | 81/62 |
| 4,123,953 | 11/1978 | Corbacho, Jr. | 81/60 |
| 4,274,309 | 6/1981 | Lenker | 81/60 |
| 4,279,314 | 7/1981 | Taub | 81/61 |
| 4,339,970 | 7/1982 | Enstrom | 81/60 |
| 4,475,420 | 10/1984 | Atkinson et al. | 81/63 |
| 4,520,697 | 6/1985 | Moetteli | 81/62 |
| 4,903,554 | 2/1990 | Colvin | 81/63 |
| 5,000,066 | 3/1991 | Gentiluomo | 81/62 |

*Primary Examiner*—Frank T. Yost

*Assistant Examiner*—Paul M. Heyrana, Sr.

*Attorney, Agent, or Firm*—Leonard Bloom

[57] ABSTRACT

A reversible ratchet wrench has a handle portion and a head portion. The head portion includes a drive member having teeth thereon and a pawl having teeth which selectively engage the teeth on the drive member. The head portion has two partially overlapping cavities formed therein, the cavities being formed from the bottom of the head portion. The top of the head portion has two spaced-apart openings formed therein, each opening communicating respectively with one of the two cavities. The drive member is disposed in the larger cavity and the pawl is disposed in the smaller cavity. A one-piece lever means is provided having a non-cylindrical stem depending therefrom. The stem is received in a cooperating bore in the pawl. A multi-sided shelf is formed on the stem, the shelf being received in a cooperating cavity in the top of the pawl. The top of the head portion of the wrench is received between the top portion of the lever means and the shelf on the stem. The larger cavity further has an inner annular groove formed near the bottom surface of the head portion. A retaining member having two circular portions is provided. The one circular portion may be received in the annular groove and the other portion is disposed in the smaller circular cavity to retain the pawl and the drive member in the head portion of the wrench. The retaining member may be removed for replacement and/or repair of the drive member and the pawl.

27 Claims, 14 Drawing Sheets

REVERSIBLE RATCHET WRENCH

FIELD OF THE INVENTION

The present invention relates to ratchet wrenches and, in particular, to the reversing lever means in the pawl and to the disposition and retention of the drive means and the pawl in the head portion of the ratchet wrench.

BACKGROUND OF THE INVENTION

The reversible ratchet wrench has been known for many years and there are numerous tools which have been disclosed with varying handles, drive means, pawls, and means for reversing the operation of the wrench.

The following patents disclose reversible ratchet wrenches:

376,584; 1,138,276; 1,140,167; 1,854,513; 1,868,839; 1,957,462; 2,658,416; 2,680,983; 2,686,446; 2,701,977; 2,720,127; 2,725,722; 2,891,434; 2,943,523; 2,957,377; 2,978,081; 2,982,160; 3,096,659; 3,140,625; 3,145,594; 3,233,481; 3,299,725; 3,369,416; 3,448,641; 3,490,317; 3,713,356; 3,724,298; 3,754,486; 3,967,514; 4,274,311; 4,277,990; 4,300,413; 4,308,769; 4,324,158; 4,328,720; 4,336,728; 4,485,700; 4,491,043; 4,532,832; 4,561,329; 4,631,988; 4,722,253; 4,903,554; 4,986,147; and French patent No. 1,029,033.

However, these ratchet wrenches are expensive to produce. The wrenches often require extensive and expensive milling operations to provide spaces in the head of the wrench for the driving means, the pawl, springs and other components. Frequently, blind openings are provided which may or may not be interconnected. These openings are usually formed in opposing faces of the head of the wrench entailing multiple tooling steps. Also, most of the wrenches include a plurality of small parts which are labor intensive to assemble. Further, the configuration and interrelation of the components, in many instances, requires a comparatively long time to assemble.

For example, the wrench of Hall (U.S. Pat. No. 4,277,990) has a closed end chamber for the ratchet gear formed from the bottom of the wrench and a closed end chamber for the pawl formed from the top of the wrench. Hall further discloses a helical spring single retaining ring means which engages kerfs in the gear chamber and on the pawl to retain the gear and pawl in their respective chambers.

A commercial model of a ratchet wrench (Sears Model 43714) which has been marketed for approximately thirty years also has chambers formed from opposite faces of the wrench and has a closed end chamber to receive the socket gear. Other references disclose the driver having a flange engaging one planar surface of the head and a planar surface of the pawl and a retainer engaging the other planar surface of the head.

There exists a need for a ratchet wrench which has comparatively few separate parts, in which the need for expensive and extensive tooling is significantly reduced, which can be assembled easily and rapidly by relatively unskilled labor, and in which repairs and replacement of parts are easily accomplished. The wrench should also permit "cosmetic" changes for different market segments.

SUMMARY OF THE INVENTION

Accordingly, it is an object of the present invention to provide a reversible ratchet wrench which is comparatively inexpensive and easy to produce and assemble.

It is another object of the present invention to provide a ratchet wrench wherein the drive means and the pawl are disposed in separate, partially overlapping cavities, the cavities being formed from the same side of the head of the ratchet wrench.

It is still another object of the present invention to provide a ratchet wrench wherein the drive means and the pawl are disposed in cavities, each cavity communicating with a separate opening in the head of the wrench, the openings extending completely through the head portion of the ratchet wrench.

It is yet another object of the present invention to provide a single base member to retain the pawl and the drive means in the head portion of the ratchet wrench without the need for washers and retaining rings.

It is still a further object of the present invention to provide a ratchet wrench in which the reversing lever means is connected to the pawl to transmit torque to the pawl when the lever means is reversed.

It is a further object of the present invention to provide a ratchet wrench in which the reversing lever means may move slightly without reversing the movement and preventing accidental movement of the pawl.

A further object of the present invention is to provide a ratchet wrench which can be easily repaired and damaged/worn parts can be easily replaced.

In accordance with the teachings of the present invention, there is herein disclosed a reversible ratchet wrench comprising a handle portion and a head portion. The head portion has a top surface and a bottom surface. The head portion includes a substantially cylindrical drive means having spaced-apart teeth oriented vertically thereon and a partially cylindrical pawl having teeth oriented vertically thereon. The pawl has a vertical bore therethrough. A lever means is connected to the pawl to permit rotation of the pawl in a first direction and in a second opposite direction. The teeth on the pawl may selectively engage the teeth on the drive means to permit rotation of the drive means in the desired direction. The head portion has a first circular cavity and a second circular cavity formed therein, the drive means being disposed in the first circular cavity and the pawl being disposed in the second circular cavity. The circular cavities are formed from the bottom surface of the head portion. The circular cavities partially overlap each other. Each circular cavity has a respective center thereof, a respective diameter and a respective axis through the respective centers, the axes of the circular cavities being substantially parallel to each other. The top surface of the head portion further has therein a first circular opening and a spaced-apart second opening therein. The openings communicate with the first circular cavity and the second circular cavity respectively. The first circular opening has a diameter smaller than the diameter of the first circular cavity. The lever means has a top position, a tab extending outwardly therefrom and a stem depending downwardly from the top portion. The stem has a shelf formed thereon. The shelf is spaced-apart from the top portion of the lever means. When the lever means is inserted through the second opening in the top surface of the head portion and the pawl is inserted into the head portion from the bottom of the second cavity, the stem of the lever means is received in and cooperates with, the vertical bore through the pawl to connect the pawl with the lever means to permit rotation of the pawl. The top surface of the head portion is received between the top portion of the lever means and the shelf on the stem, wherein the lever means is secured in the second opening in the top surface of the head portion and the lever means and pawl are easily removable for repair and replacement. Movement of the tab in a first direction produces movement of the pawl and permits movement of the drive means in the first direction. Movement of the tab in a second opposite direction produces movement of the pawl and permits movement of the drive means in the second opposite direction. Means are provided for retaining the drive means and the pawl in the head portion.

In a preferred embodiment the first circular cavity has an internal annular groove formed thereabout, the groove being near the bottom surface of the head portion. The retaining means has two circular portions, wherein the retaining means may be disposed in the circular cavities. One circular portion is received in the groove in the first circular cavity and the other circular portion is received in the second circular cavity. The retaining means is substantially parallel to the bottom surface of the head portion such that the drive means is retained in the head portion by the one circular portion and the pawl is retained in the head portion by the other circular portion of the retaining means. The retaining means further prevents the entry of dirt into the cavities. The retaining means is easily removable for repair and replacement of the drive means and of the pawl.

The one circular portion of the retaining means may comprise a pair of bifurcated arms forming a substantially circular opening therebetween. The retaining means has means on the bifurcated arcuate arms to permit said arms to be moved towards one another to permit the arms to be received in, and removed from, the annular groove. The drive means has a drive tang formed on the drive means. The drive means is received in the circular opening formed by the bifurcated arms.

These and other objects of the present invention will become apparent from a reading of the following specification, taken in conjunction with the enclosed drawings.

DESCRIPTION OF THE PREFERRED EMBODIMENT

Figure 1:
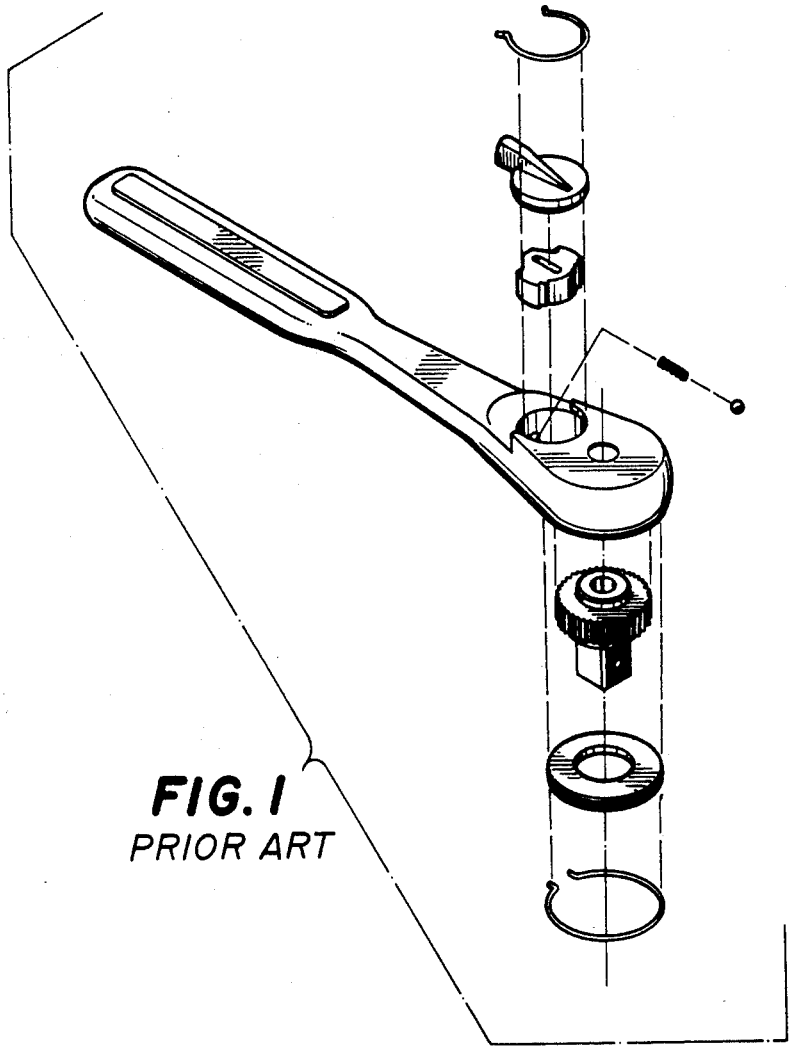
FIG. 1 PRIOR ART
FIG. 1 is an exploded view of a ratchet wrench of the prior art.
Figure 2:
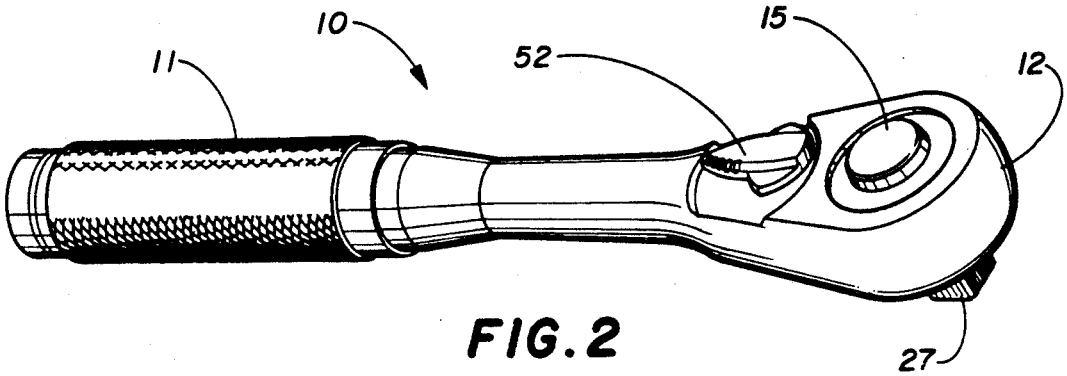
FIG. 2 is a perspective view of the ratchet wrench of the present invention.
Figure 3:
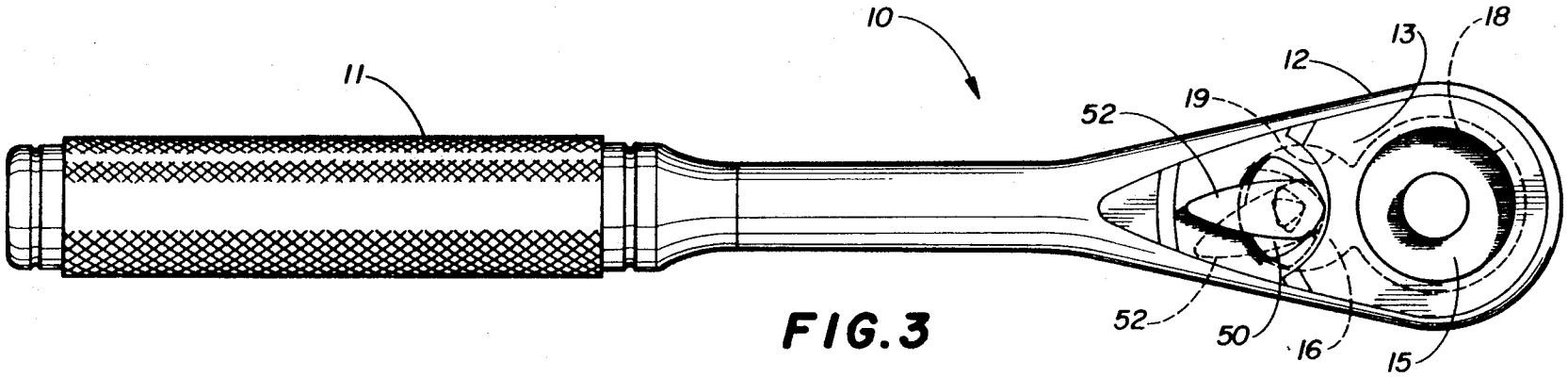
FIG. 3 is a top view of the head portion of the present invention, showing in phantom lines, the movement of the tab of the lever means.
Figure 4:
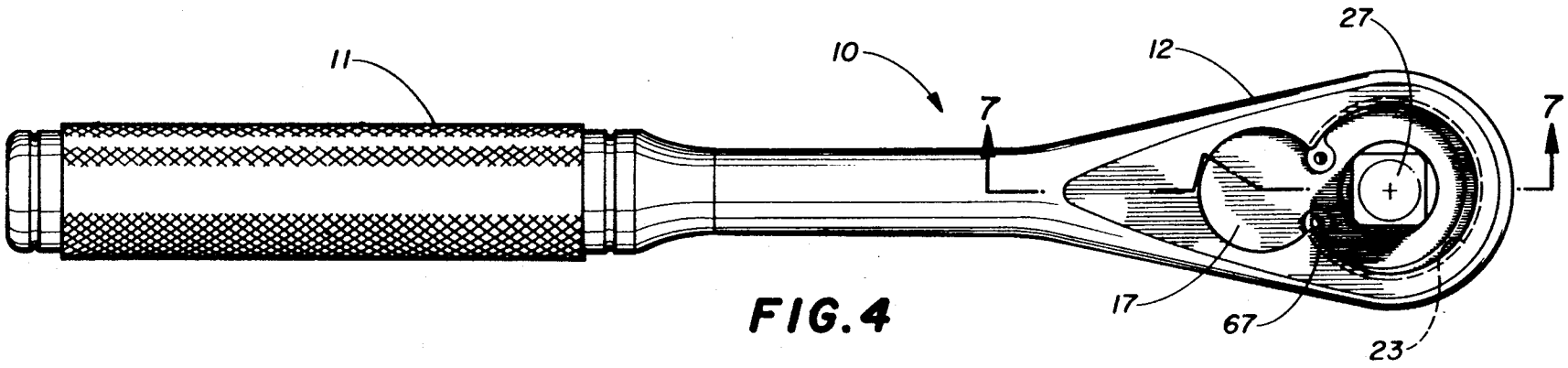
FIG. 4 is a bottom view of the head portion of FIG. 3.

The prior art shown in FIG. 1 illustrates a design in which the drive means and the pawl are disposed in cavities which are formed from opposite surfaces of the wrench. Separate flanges are provided to retain the drive means and the pawl in respective cavities. The reversing lever is mounted in an unprotected manner and is susceptible to accidental movement.

Referring now to FIGS. 2-6, the ratchet wrench 10 has a handle portion 11 and a head portion 12. The head portion has a top surface 13 and a bottom surface 14. Disposed in the head portion 12 is a drive means 15 and a pawl 16. A retaining means 17 is disposed in the head portion 12 to retain the drive means 15 and the pawl 16 as is described below.

Figure 5:
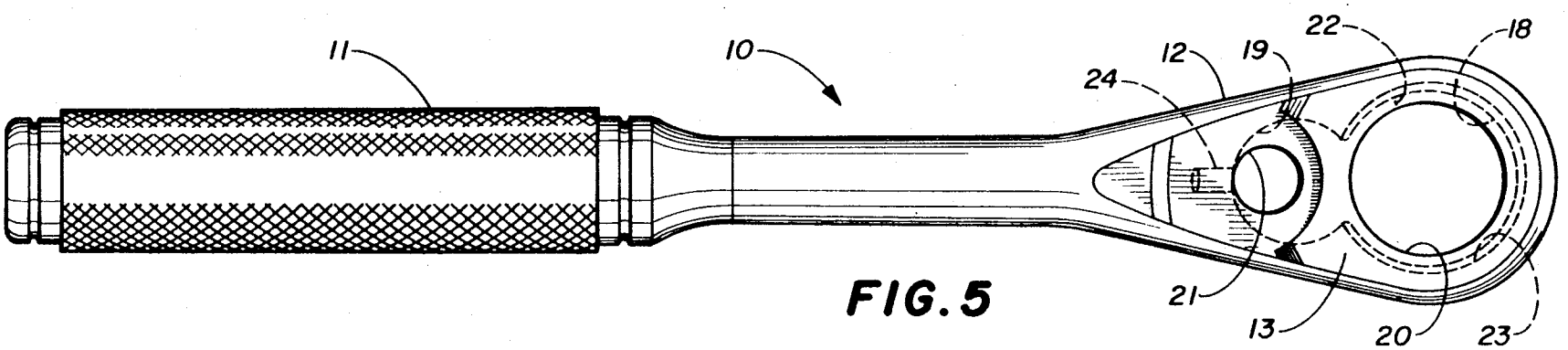
FIG. 5 is a top view of the head portion of the present invention with the drive means, the pawl and the retaining means removed.
Figure 6:
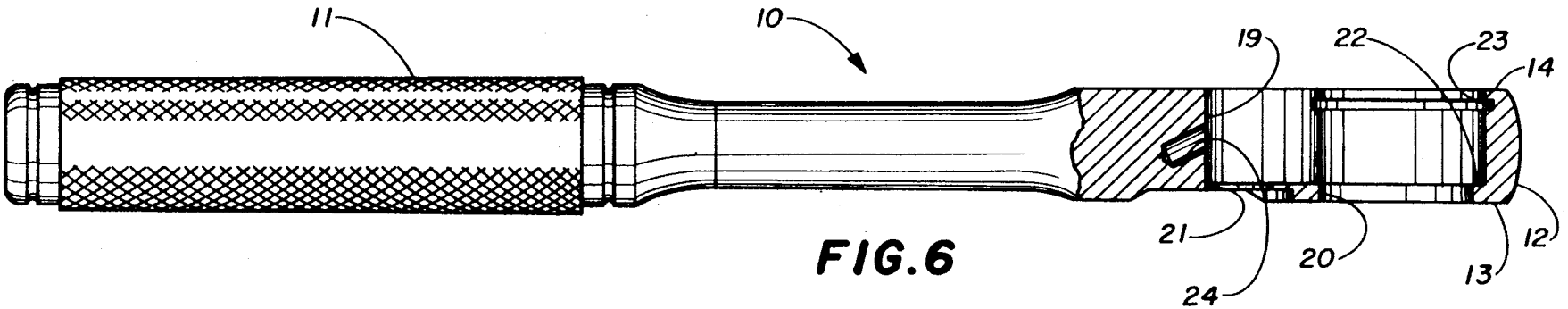
FIG. 6 is a side view in partial cross section across the lines 6—6 of FIG. 5.

The head portion, as shown in FIGS. 5 and 6 has two circular cavities formed therein, a first cavity 18, distal to the handle portion 11 and a second cavity 19, proximal to the handle portion 11. The cavities 18, 19 are formed from the bottom surface 14 of the head portion 12 and extend upwardly into the head portion 12. The cavities 18, 19 may be formed by boring, milling, forging, casting or other means known to those skilled in the art. The cavities partially overlap one another. Each cavity has a respective center, a respective diameter, and a respective axis through the respective centers. The axes of the circular cavities are substantially parallel to each other. The second cavity 19 has a diameter smaller than the diameter of the first cavity 18. The top surface 13 of the head portion 12 further has a pair of openings formed therein. The first opening 20 is circular and is spaced apart from the second opening 21. The first opening 20 communicates with the first cavity 18 and the second opening 21 communicates with the second cavity 19. The second opening 21 is formed in a depression in the top surface 13 of the head portion 12 about the second opening 21 and extending toward the handle portion 11 of the wrench 10. A rearward facing ledge 37 is formed between the forward portion of the depression and the second opening. The first opening 20 has a center and an axis therethrough; the axis corresponding to the axis of the first circular cavity 18. The second opening 21 is approximately circular in shape. In this manner, the first opening 20 is directly aligned with the first cavity 18 and the second opening is directly aligned with the second cavity 19. The diameter of the first opening 20 is smaller than the diameter of the first cavity 18. Consequently, a first shoulder 22 is formed on the top surface 13 of the head portion 12 about the top of the first cavity 18. Also formed internally in the first cavity 18, near the bottom surface of the head portion 12, is an annular groove 23. The annular groove 23 is formed near the bottom surface 14 of the head portion and is substantially parallel to said bottom surface 14.

In the wall of the second cavity 19, there is also formed a blind-ended bore 24 which, preferably is angled upwardly from the bottom surface 14 of the head portion 12 and directed toward the handle portion 11. The upward angle reduces the collection of dirt in the bore 24.

The drive means 15 is substantially cylindrical and is disposed in the first cavity 18 (FIGS. 3, 4 and 7–10). The diameter of the drive means 15 is slightly smaller than the diameter of the first circular cavity 18. A plurality of teeth 25 are uniformly spaced apart about the circumference of the drive means 15. The teeth 25 are parallel to the axis of the first circular cavity 18. On the top of the drive means 15, there is a cylindrical boss 26. The boss 26 has a diameter slightly smaller than the diameter of the first opening 20 and the boss 26 is received in the first opening 20 when the drive means 15 is disposed in the first circular cavity 18. When so disposed, the first shoulder 22 surrounds the boss 26 on the drive means 15 and retains the body of the drive means 15. The boss 26 has a top surface which is coplanar with the top surface 13 of the head portion 12. Also, when so disposed, the drive means 15 may rotate about the axis of the first circular cavity 18. A drive tang 27 is formed integrally with the drive means 15 and extends downwardly from the bottom of the drive means 15. The top of the drive tang 27 is circular where the drive tang 27 is joined to the bottom of the drive means 15. The top of the drive tang 27 has a diameter smaller than the diameter of the drive means 15. In this manner, a shoulder 28 is formed on the bottom of the drive means. The body of the drive tang 27, which extends from the circular top of the drive tang 27, is substantially square but may be other shapes, and is formed in dimensions to be received in a conventional socket wrench. Also the body of the drive tang 27 may have a detent means mounted therein to retain a conventional socket wrench in a manner known to persons skilled in the art. The teeth 25 on the drive means extend from the bottom of the boss 26 to the shoulder 28.

Figure 7:
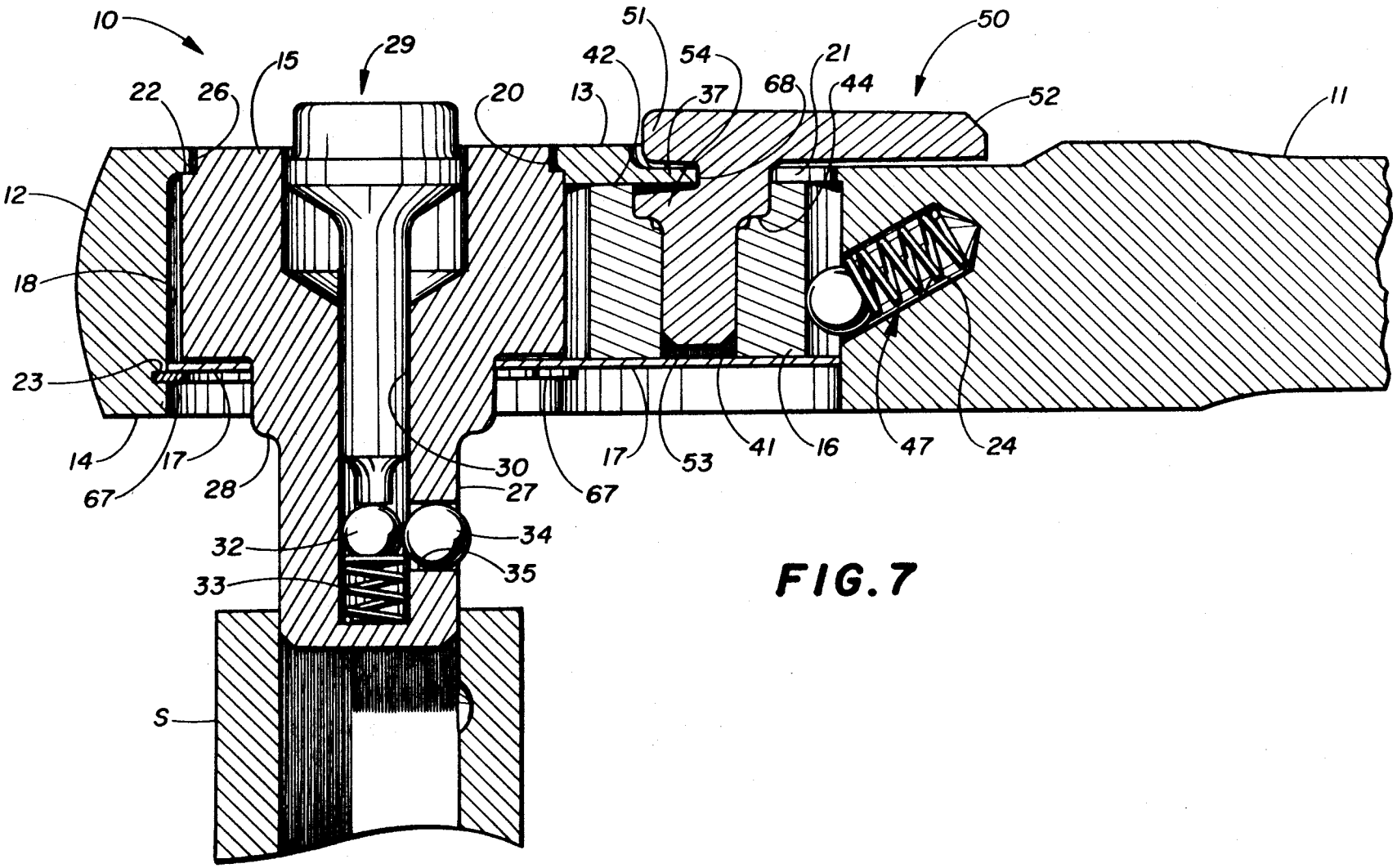
FIG. 7 is a cross section of FIG. 4 taken across the lines 7—7 with the quick release means not being shown in cross section.
Figure 10:
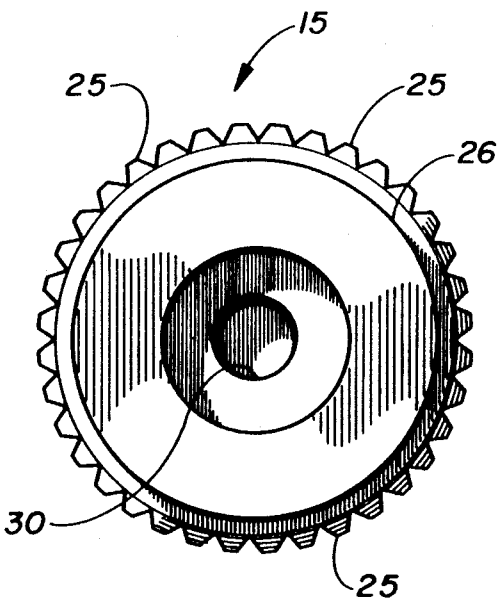
FIG. 10 is a top view of the drive means of FIG. 8.
Figure 9:
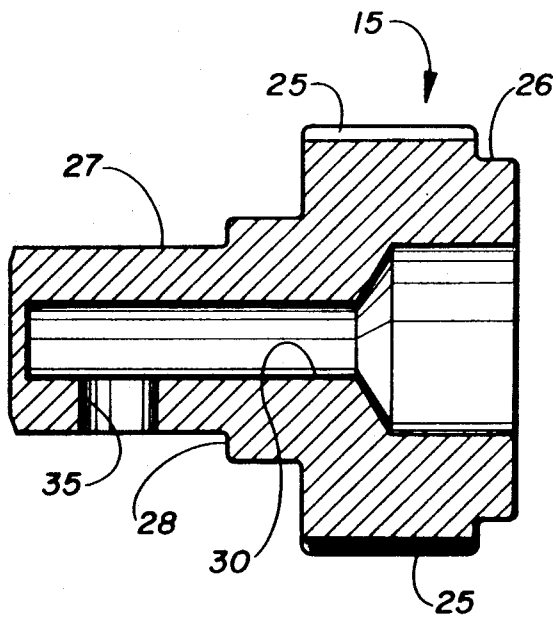
FIG. 9 is a cross section view along the lines 9—9 of FIG. 8.
Figure 8:
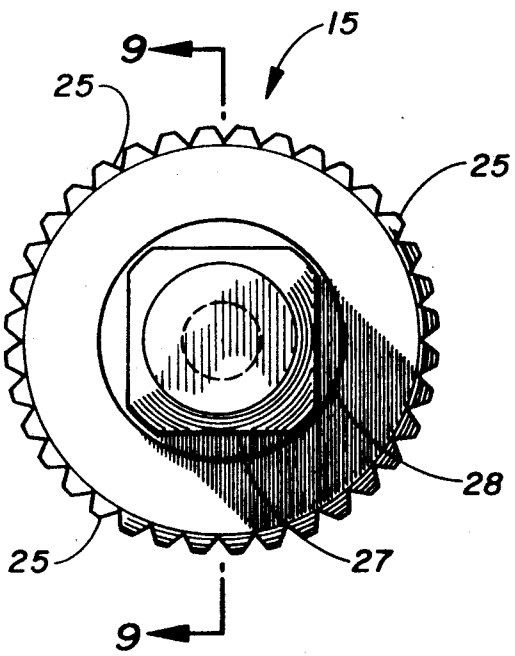
FIG. 8 is a bottom view of the drive means of the present invention.
Figure 14:
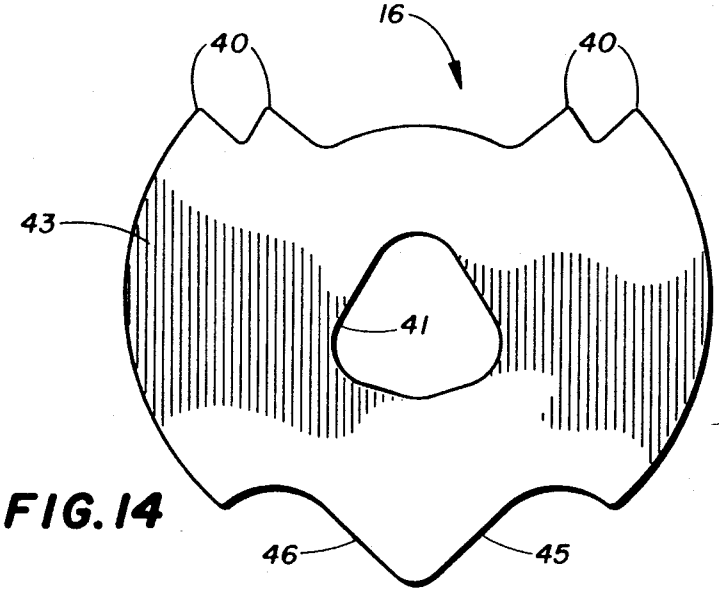
FIG. 14 is a bottom view of the pawl of FIG. 11.
Figure 13:
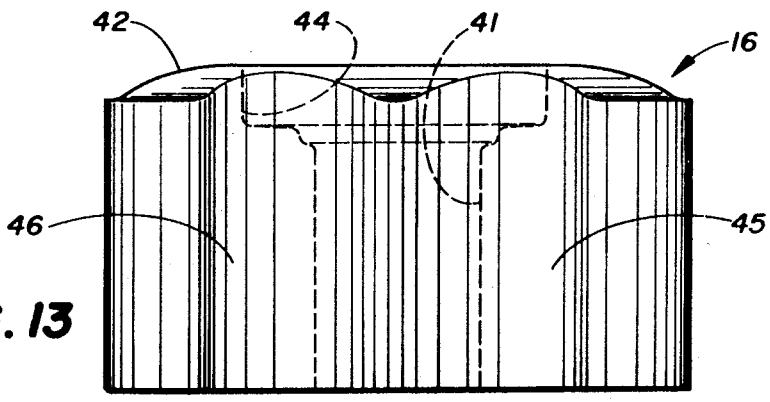
FIG. 13 is a front view of the pawl of FIG. 11.
Figure 11:
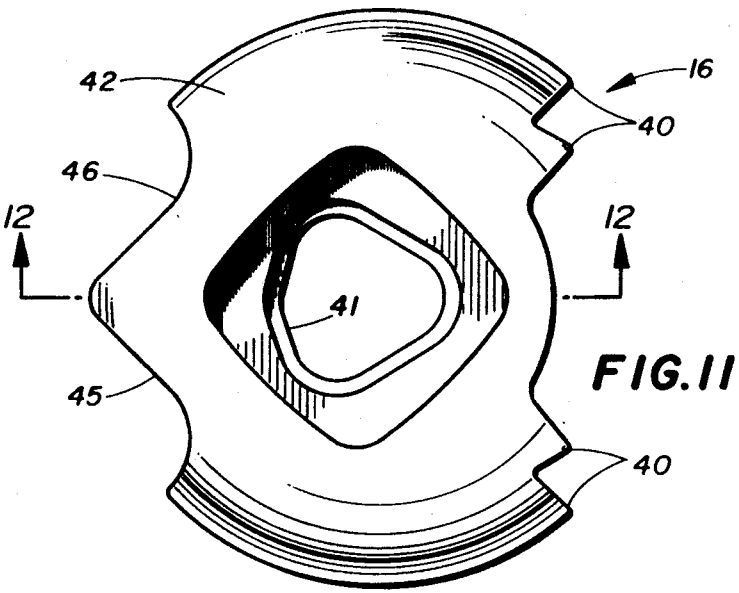
FIG. 11 is a top view of the pawl of the present invention.
Figure 12:
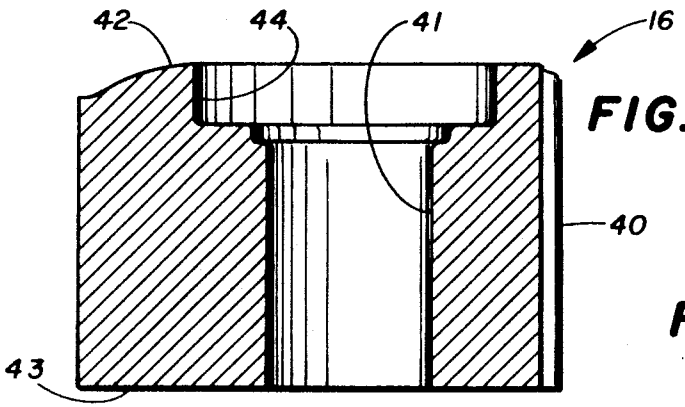
FIG. 12 is a cross section taken across the lines 12—12 of FIG. 11.
Figure 18:
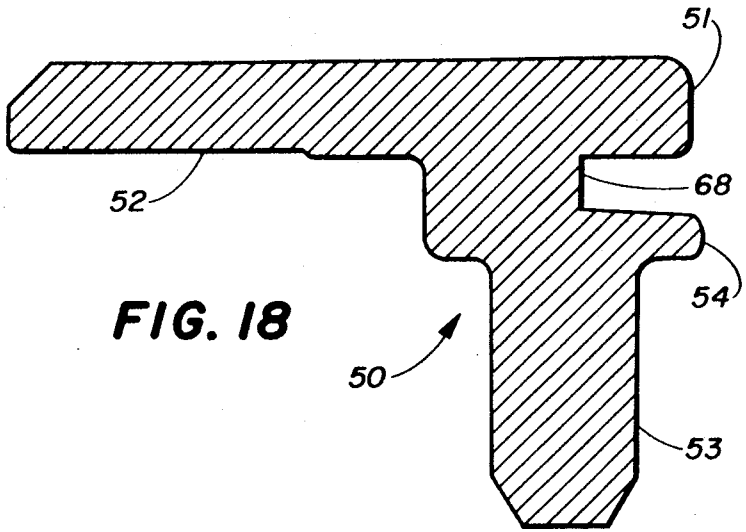
FIG. 18 is a cross section taken across the lines 18—18 of FIG. 17.
Figure 19:
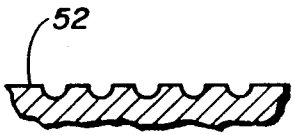
FIG. 19 is a cross section taken across the lines 19—19 of FIG. 17.
Figure 16:
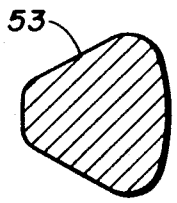
FIG. 16 is a cross section taken across the lines 16—16 of FIG. 15.
Figure 15:
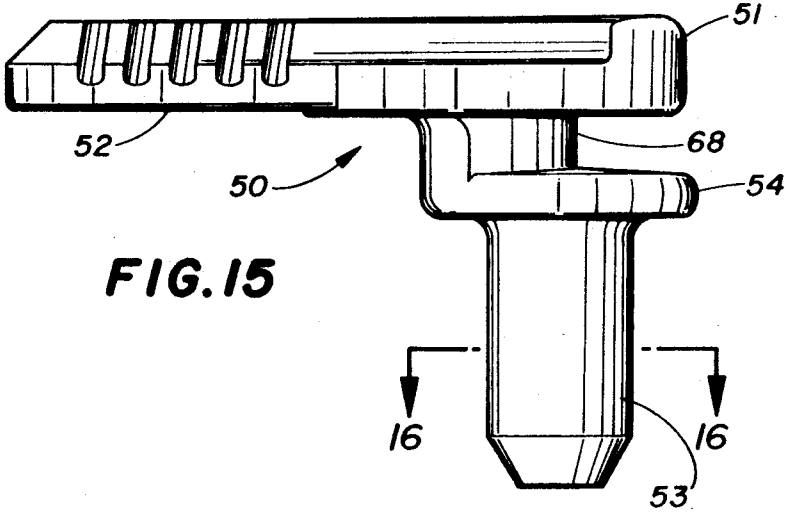
FIG. 15 is a side view of the lever means of the present invention.
Figure 17:
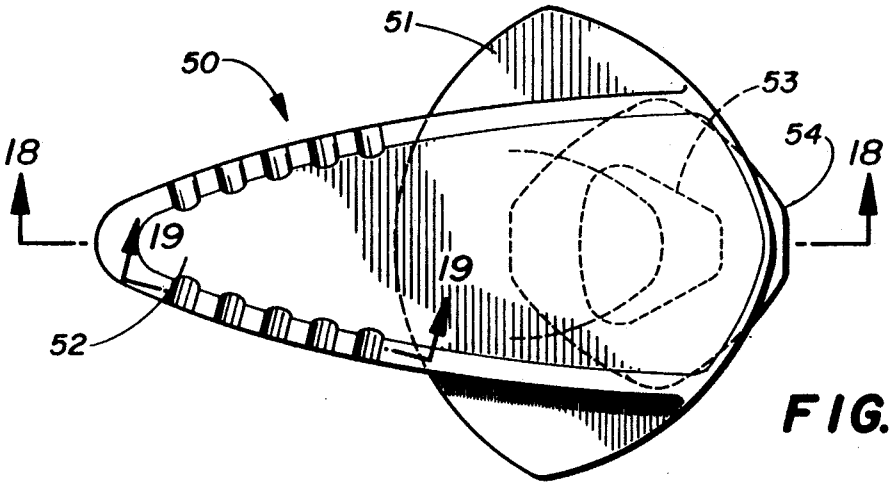
FIG. 17 is a top view of the lever means of FIG. 15.
Figure 20:
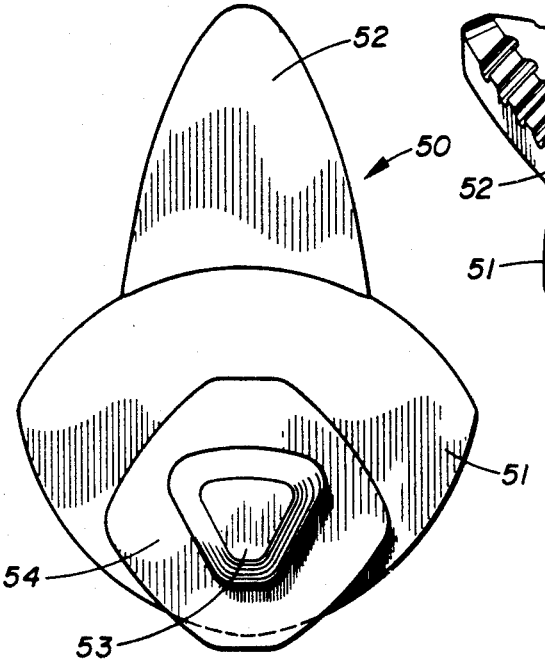
FIG. 20 is a bottom view of the lever means of FIG. 15.
Figure 22:
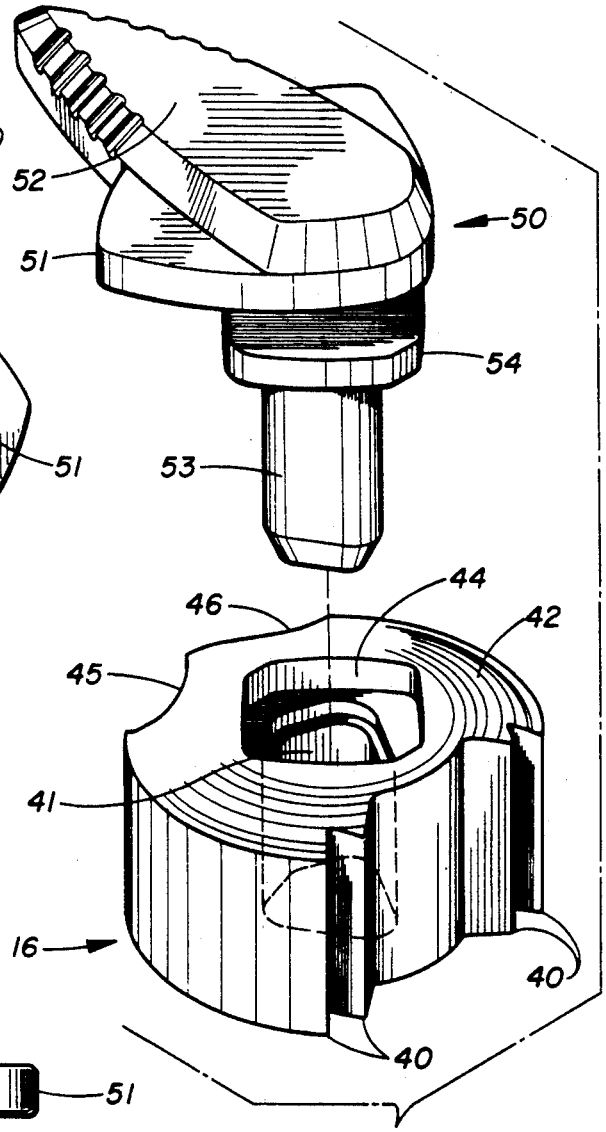
FIG. 22 is a perspective view showing the lever means in relation to the pawl.
Figure 21:
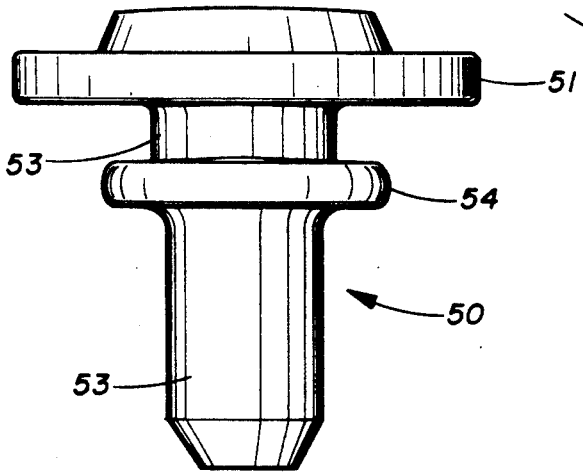
FIG. 21 is a front view of the lever means of FIG. 15.

The ratchet wrench 10 may also be provided with a quick release mechanism 29 wherein the user may easily and quickly connect and release the socket S from the tang 27. The quick release mechanism 29 is disposed in the drive means 15. As shown in FIG. 7, the quick release mechanism 29 comprises a blind bore 30 in the drive means 15 and a plunger 31 received in the bore 30. The top of the plunger extends outwardly above the top surface 13 of the head 12 wherein the user may easily push on the top of the plunger 31. The bottom of the plunger 31 is in contact with a ball means 32 which in turn, is in contact with a spring means 33 which is disposed in the blind end of the bore 30. Pressure on the top of the plunger 31 pushes the ball means 32 downwardly in the bore 30 against the urging of the spring means 33. A detent ball 34 disposed in a detent opening 35 adjacent to the ball means 32, in the side of the tang is thereby permitted to move inwardly toward the bore 30 so that the socket S may be moved upwardly on the tang 27 to engage the detent ball 34 or downwardly on the tang 27 to disengage the detent ball 34. Release of pressure on the top of the plunger 31 permits the spring means 33 to urge the ball means 32 upwardly in the bore 30, exerting pressure on the detent ball 34. The detent ball 34 is thereby moved outwardly in the detent opening so that a portion of the detent ball extends outwardly from the surface of the tang 27 and engages a corresponding member of the socket S to retain the socket S on the ratchet wrench 10. Other embodiments of quick release mechanisms known to persons skilled in the art may be incorporated into the reversible ratchet wrench of the present invention.

As shown in FIGS. 11–14, the pawl 16 is partially cylindrical. A portion of the circumference of the pawl 16 has a plurality of uniformly spaced-apart teeth 40 formed thereon. The teeth 40 on the pawl extend the entire height of the pawl parallel to the axis of the second circular cavity 19 when the pawl is disposed in the second cavity 19. When so disposed, the teeth 40 of the pawl 16 selectively engage the teeth 25 on the drive means 15. In this manner, when the teeth 40 on the one side of the pawl 16 engage the teeth 25 on the drive means 15, the drive means may rotate in a first direction but are prevented from rotation in a second opposite direction. Similarly, when the teeth 40 on the other side of the pawl 16 engage the teeth 25 on the drive means 15, the drive means may rotate in a second direction but are prevented from rotation in a first opposite direction. The pawl 16 has a center bore 41 therethrough from the top 40 of the pawl 16 to the bottom 43 of the pawl 16. Preferably, the bore 41, is not cylindrical but is polygonal in shape. The top 42 of the pawl 16 further has a multi-sided cavity 44 formed therein about the bore 41. The pawl 16 further has a pair of spaced-apart pockets 45, 46 formed thereon, the pockets 45 being approximately diametrically opposite to the teeth 40 on the pawl 16. The pockets 40 may extend the entire height of the pawl 16 or may extend from the bottom of the pawl to a point near the top 42 of the pawl 16. The pockets 40 receive therein a detent means 47 which is contained in the bore 24 in the second cavity 19. When the pawl 16 is moved by the reversing lever 50 in a first direction or a second direction (as described below), the detent means 47 is received in the first pocket 46 or the second pocket 47 on the pawl 16. In a preferred embodiment, a detent means 47 is provided as described in copending application Ser. No. 755,783 filed Sep. 6, 1991.

Figure 23:
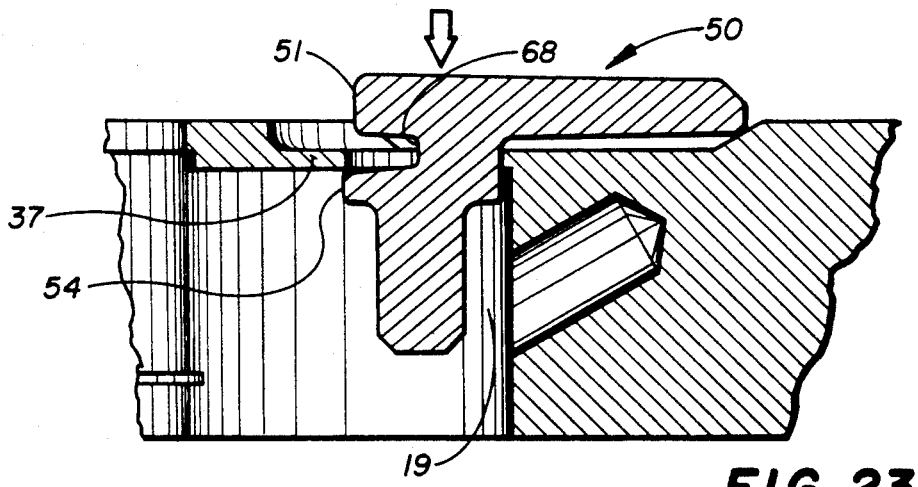
FIG. 23 is a side view showing the top portion of the head about to be received between the top of the lever means and the shelf on the stem of the lever means.
Figure 24:
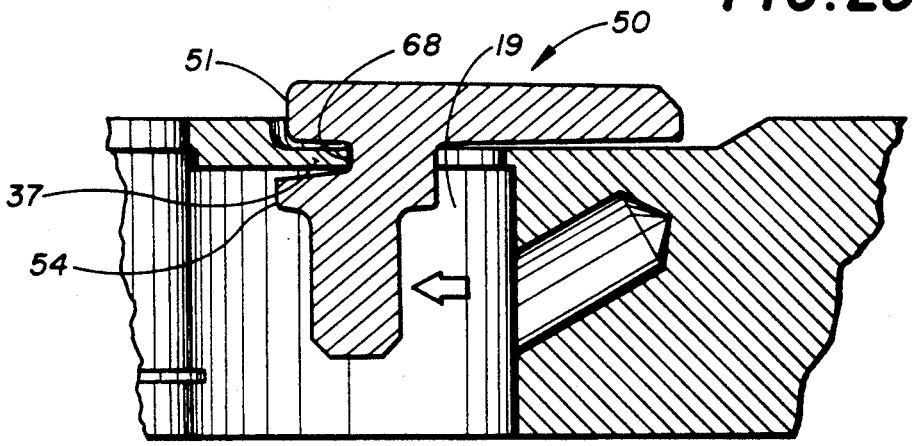
FIG. 24 is a side view showing the top portion of the head received between the top portion of the lever means and the shelf on the stem of the lever means.
Figure 25:
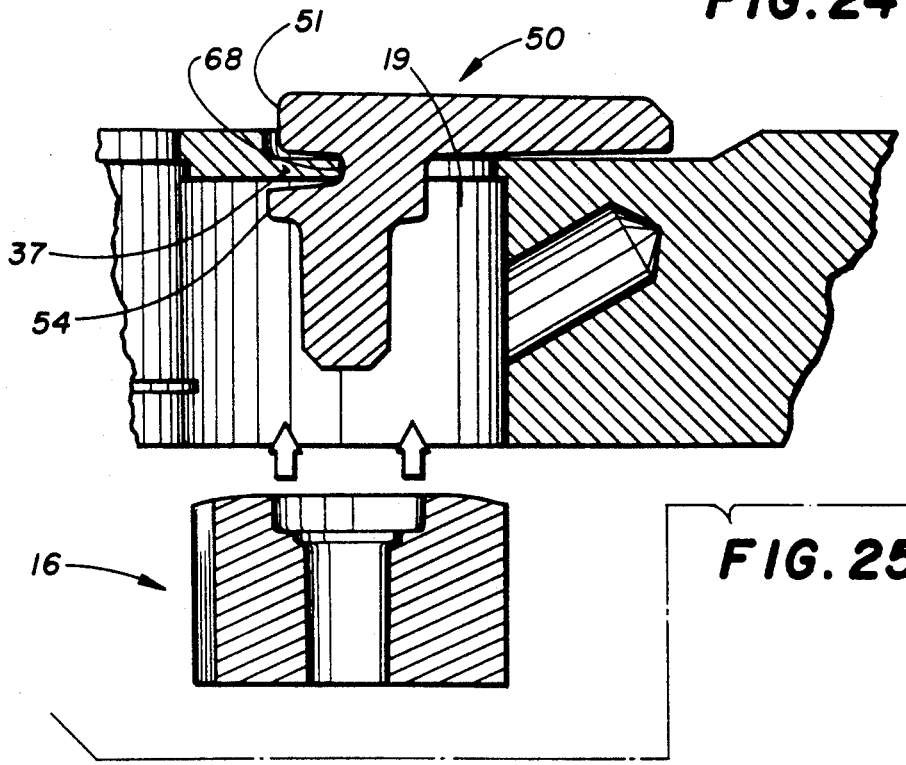
FIG. 25 is a side view in partial cut-away showing the insertion of the pawl from the bottom of the second cavity to receive the stem and shelf of the lever means.

A lever means 50 is connected to the pawl 16 to permit rotation of the pawl in a first direction and in a second opposite direction (FIGS. 15–21). The lever means 50 has a top portion 51 on which a tab 52 is formed extending outwardly therefrom. The tab 52 may be textured and/or grooved to reduce slippage when the tab is grasped by a person using the wrench. The lever means 50 is disposed in depression in the top surface 13 of the head portion 12. A stem 53 depends downwardly from the top portion 51. The stem 53 has an intermediate portion provided with a recess 68 and forming a shelf 54 thereon. As shown in FIGS. 15, 17–22, the shelf 54 is multi-sided, is received in and cooperates with, the multi-sided cavity 44 formed in the top 42 of the pawl 16. The stem 53 is polygonal in shape and cooperates with the bore 41 in the pawl 16. When the stem 53 of the lever means 50, is inserted through the second opening 21 in the top 13 of the head portion 12, the tab 52 is oriented toward the handle portion 11 of the wrench. The lever means 50 is slid in a direction away from the handle portion 11 towards the head portion 12 such that the ledge 37 on the top surface 13 of the head portion 12 is received between the top portion 51 of the lever means 50 and the shelf 54, thereby securing the lever means 50 in the second openings 21 (FIGS. 23–25). The pawl 16 is inserted into the second cavity 19 from the bottom 14 of the head and the stem 53 is received in the center bore 41 in the pawl 16.

In this manner, the pawl 16 may be easily and quickly inserted in the head portion 12 with minimum labor costs and with a minimum number of components. The pawl 16 and lever means 50 are secured to one another and to the head portion 12 of the wrench 10. Further, due to the cooperating nature of the shelf 54 with the cavity 44 in the pawl 16 and of the stem 53 on the lever means 50 with the bore 41 in the pawl 16, movement of the tab 52 on the lever means 50 directly transmits torque to the pawl 16 and movement of the pawl 16 permits movement of the drive means 15 in a desired direction. Furthermore, due to these cooperating surfaces, the tolerances need not be exact which reduces manufacturing costs. The design also permits "play" in the lever means 50 so that accidental bumping of the tab 52 does not result in reversal of the direction of the drive of the ratchet wrench. In addition, this configuration reduces the possibility for dirt to enter the top of the second cavity 19 in which the pawl 16 is located. The simplified assembly procedure results in a pawl mechanism which is easily repairable and/or replaceable. This ease of repair/replacement is further increased by the retaining means 17 as described below. The lever means 50 may be formed as a die cast unit to eliminate assembly operations. The pawl 16 is preferably formed of metal, and in a preferred embodiment is formed from powdered metal, although other materials or construction may be used. The use of powdered metal facilitates fabrication of the pawl to reduce fabrication costs. Also, the use of powdered metal permits relatively simple and inexpensive formation of the cavity 44 in the top of the pawl 16 to receive the shelf 54 on the stem 53 of the lever means 50.

Referring now to FIGS. 26–31 a retaining means 17 is provided. In a preferred embodiment, the retaining means 17 has two approximately circular portions 55, 56. The one circular portion 55 comprises a pair of bifurcated arcuate arms 57 extending outwardly from the other circular portion 56. The arms 57 are in the same plane as the other circular portion 56. The other circular portion 56 has a diameter slightly smaller than the diameter of the second cavity 19. The arcuate bifurcated arms 57 form a substantially circular opening within the arms 57, the circle having a diameter smaller than the diameter of the drive means 15 and larger than the diameter of the top of the drive tang 27. The bifurcated arms 57 have ends 58 which are spaced apart from each other.

Figure 26:
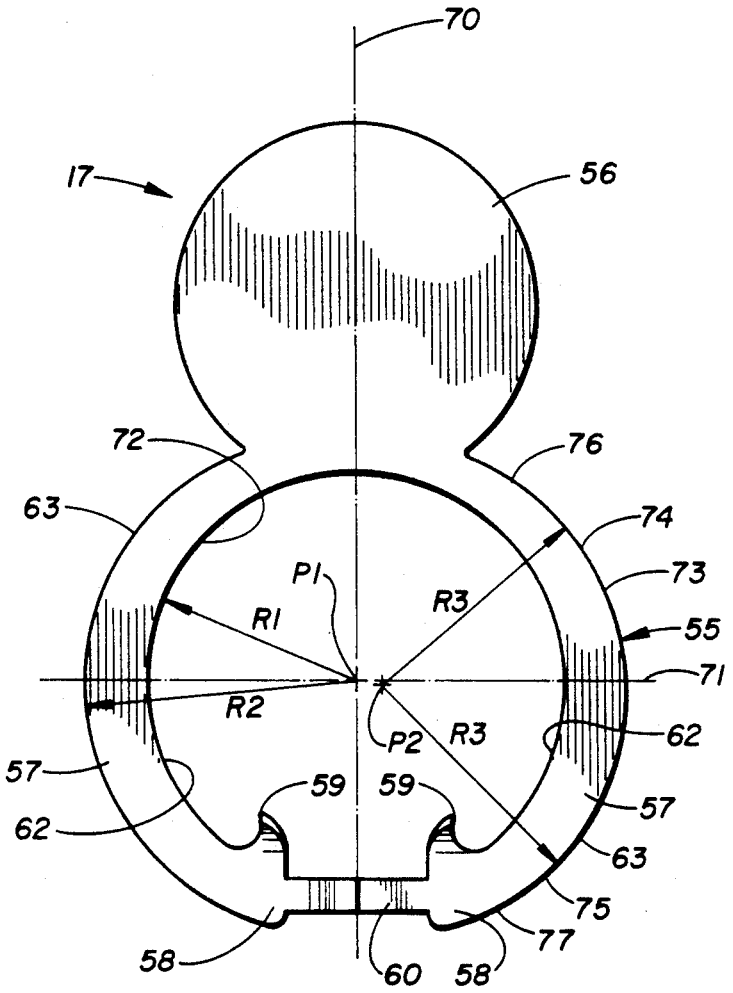
FIG. 26 is a top view of the retaining means of the present invention.
Figure 27:
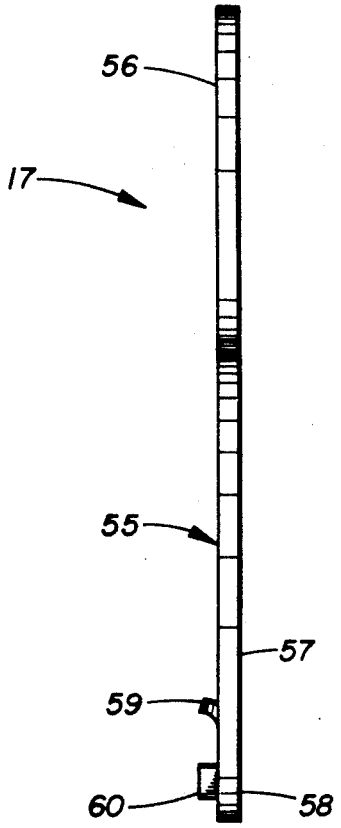
FIG. 27 is a side view of FIG. 26.
Figure 28:
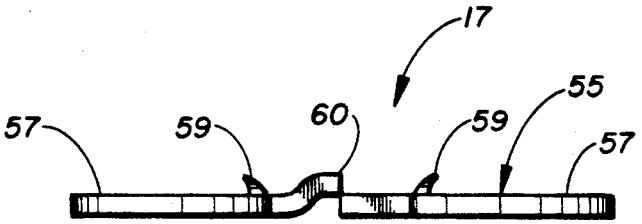
FIG. 28 is an end view of FIG. 26.
Figure 29:
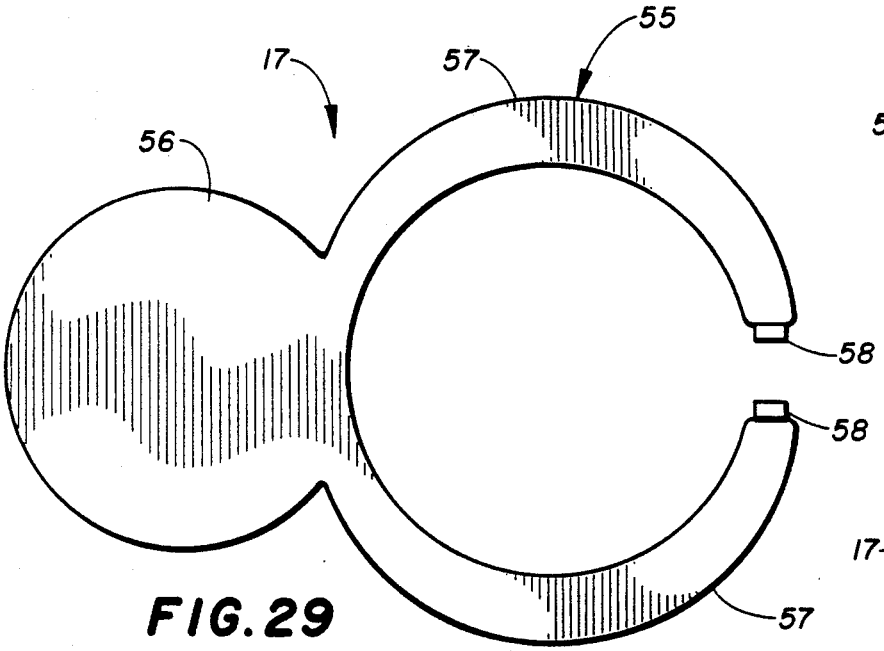
FIG. 29 is a top view of an alternate embodiment of a retaining means of the present invention.
Figure 30:
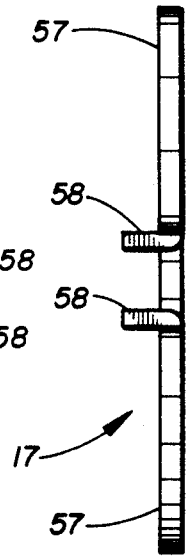
FIG. 30 is an end view of FIG. 29.
Figure 31:
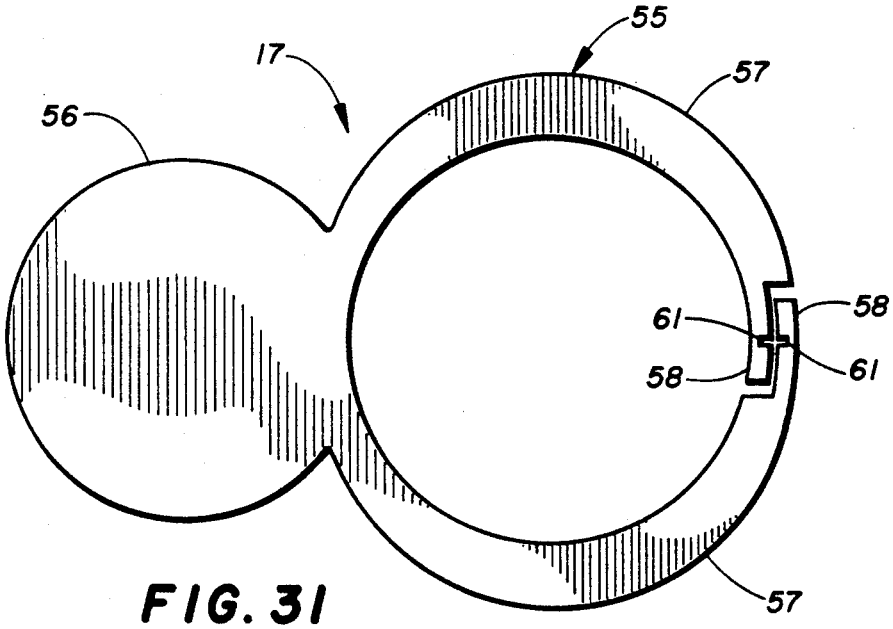
FIG. 31 is a top view of still another embodiment of a retaining means of the present invention.

The arms are formed from arcs of differing radii as shown in FIG. 26. The inner surface 62 of each arm is a circular arc 72 at a radius R1 from the point P1 at the center of the opening formed by the arms 57, 57. This center point Pl is further defined as the intersection of the center line 70 which extends the length of the retaining means 17 and the center line 71 which perpendicular to center line 70 and which further is at the center of the one circular portion 55. The retaining means 17 is symmetrical about the center line 70.

The outer surface 63 of each arm is not concentric with the inner surface 62 and is defined by two different radii, R2 and R3. Radius R2 is also measured from point Pl and extends to about the midpoint of the outer surface 63 of the respective arm 57 and further extends in both directions in an arc 73 to include approximately one-half the circumference of the outer surface 63 of the respective arm 57. The arc 73 so described has edges 74, 75 at each of its extremities distal from the midpoint thereof. Radius R3 is measured from a point P2 which is exocentric of the one circular portion 55. For each respective arm 57, point P2 is displaced approximately one-twelfth (1/12) of the distance between the center line 70 and the outer surface 63 of the respective arm 57. Point P2 is also displaced away from the circular portion 56 approximately one-forty-fifth (1/45) of the distance between the center line 71 and the inner surface of the respective arm 57 near the end 58. Radius R3 extends in two arcs 76, 77 from point P2 to the outer surface 63 of the respective arm 57 to join edges 74, 75 of the arc 73 described by radius R2. One arc 76 extends from the edge 74 toward the center line 70 to terminate at the conjoint of the arm 57 with circular portion 56. The other arc 77, extends from the edge 75 to the end 58 of the arm 57. Since the retaining means 17 is symmetrical, both arms 57, 57 have the identical configuration but are mirror images of each other.

The compound radii compensate for the uniform flexing over the entire length of the arms 57 when the arms are squeezed together. Thus, the displacement of the arms 57 is very small at the juncture of the arms 57 with the other circular portion 56. The circumference of the outer surface 63 of the arms 57 cannot be completely circular in order for the outer surface 63 of the preportion 55 to be received in the first cavity 18. When the ends 58 of the arms 57 are squeezed together to insert the retaining means 17 in the annular groove 23, or to remove the retaining means 17 therefrom, the outer surface 63 of the retaining means 17 has a diameter smaller than the diameter of the first cavity 19. When the ends 58 of the arms 57 are released, the outer surface 63 of the arms 57 are received in the annular groove 23 and thereby retain the drive means 15 and the pawl 16 in their respective cavities 18, 19.

In one embodiment (FIGS. 26–28) each arm has an inwardly-shaped hook 59 formed thereon. The hooks 59 may be grasped by a tool to move the arms 57 toward one another (to reduce the diameter of the circle formed by the arms 57) to permit the arms to be received in, or removed from, the annular groove 23 in the first cavity 18 near the bottom surface 14 of the head portion 12. The end of one arm 57 has a bend 60 thereon so that the end of the one arm is in a plane adjacent to the plane of the end of the other arm. The bent end 60 extends outwardly from the bottom surface 14 of the head portion 12 when the retaining means 17 is disposed in the annular groove 23. In this manner, the respective ends of two arms are substantially butted together and virtually no open spaces are available for dirt and other materials to enter the cavity 18 and cause possible damage to the driving means 15. In another embodiment (FIGS. 29–30), the ends 58 of the arms 57 are bent approximately 90° from the plane of the arms 57 wherein the ends 58 of the arms 57 may be grasped by a tool and the arms 57 moved towards one another to close the space therebetween. When so moved, the arms 57 may be received in the inner annular groove 23 in the first cavity 18 near the bottom surface 14 of the head portion 12. In still another embodiment (FIG. 31) the ends 58 of the arms 57 are disposed adjacent to each other, both arms 57 being in the same plane. A kerf 61 is formed in each arm 57, the kerfs being aligned to be directly opposed to one another. Placing a flat blade, such as a screwdriver blade, in the kerfs 61 and twisting the blade causes the arms 57 to move towards one another to permit the arms 57 to be received in, or removed from, the annular groove 23. The trailing edge of each kerf 61 may be rounded to permit twisting in a desired direction only.

In all the embodiments having bifurcated arms 57, the arms are formed from arcs having three (3) differing radii.

The retaining means 17 is disposed in the head portion 12 by placing the retaining means 17 parallel to the bottom surface 14 of the head portion 13 with the circular portion 56 of the retaining means 17 directed toward the handle portion 11 of the wrench 10. The ends 58 of the arms 57 of the retaining means 17 are moved close together in a spring-like manner (reducing the diameter of the circle formed within the arms 57), the arms 57 are received in the annular groove 23 and permitted to spring back to the fully open position to be supported in the cavities 18, 19. The circular portion 56 of the retaining means 17 is disposed in the bottom of the second circular cavity 19. When so disposed, the retaining means 17 retains the pawl 16 and the drive means 15 within the head portion 12 of the wrench 10 and spaced apart from the bottom surface 14 of the head portion 12. The flat bottom surface 43 of the pawl 16 is retained by the circular portion 56 of the retaining member 17. The shoulder 28 on the bottom of the drive means 15 is retained by the arcuate arms 57 of the retaining means 17. The drive tang 27 extends between the arms 57 of the retaining member. The retaining means 17 reduces the entry of dirt into the cavities 18, 19 and reduces wear and damage to the driving means 15 and the pawl 16.

Figure 32:
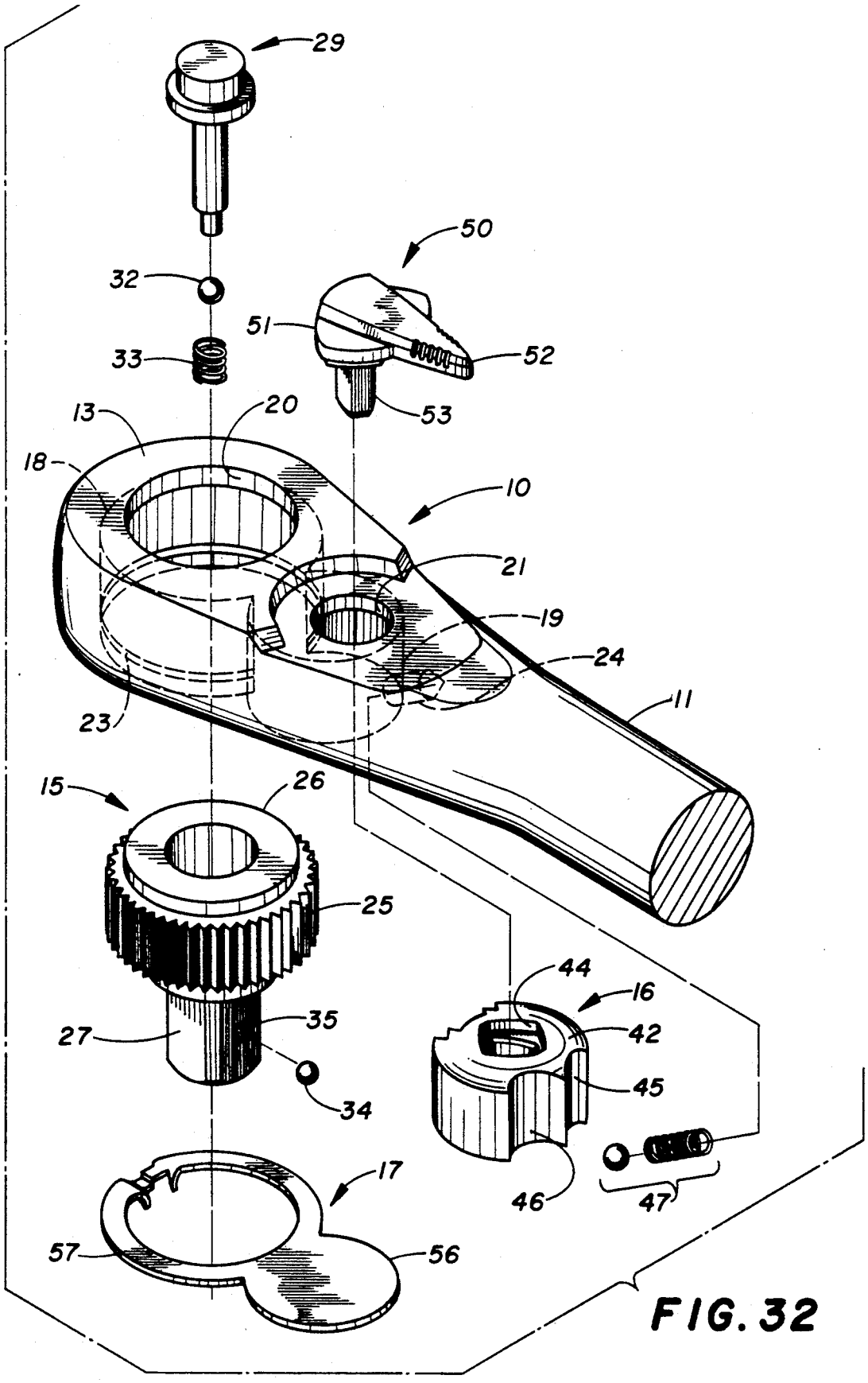
FIG. 32 is an exploded view of the present invention.

The retaining means 17 may also be easily removed from the head portion 12 of the wrench 10 by moving the ends 58 of arms 57 together to release the arms 57 from the annular groove 23 to reverse the above-described procedure. When the retaining means 17 are removed, damaged or worn drive means 15 and/or pawl 16 may be repaired or replaced with a minimum of time and labor (FIG. 32).

Figure 33:
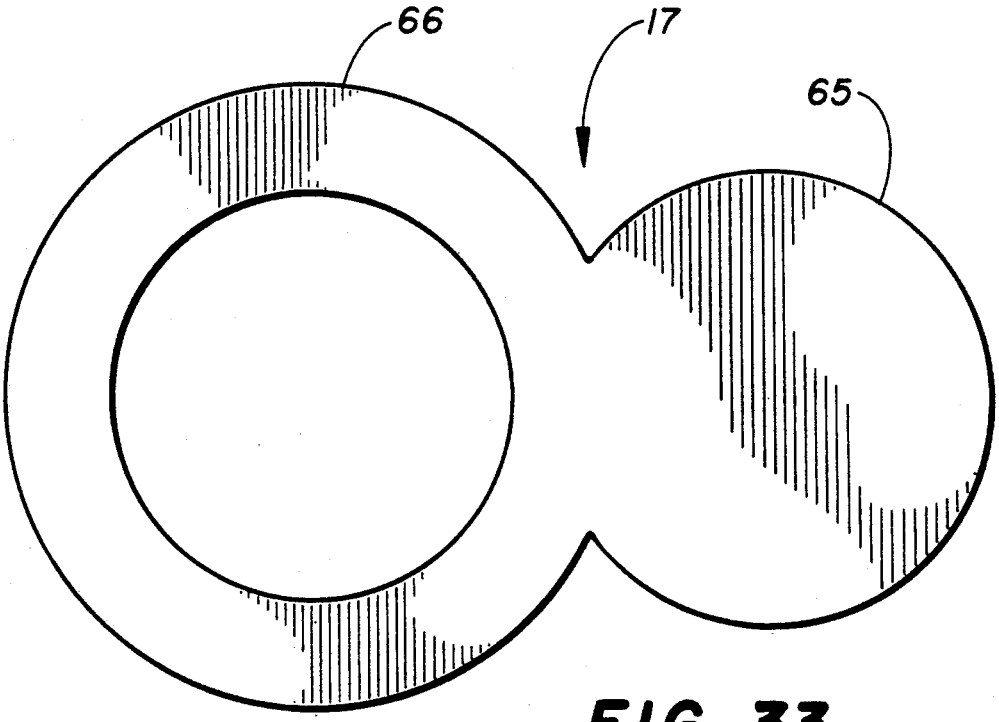
FIG. 33 is a top plan view of yet another embodiment of a retaining means of the present invention.
Figure 34:
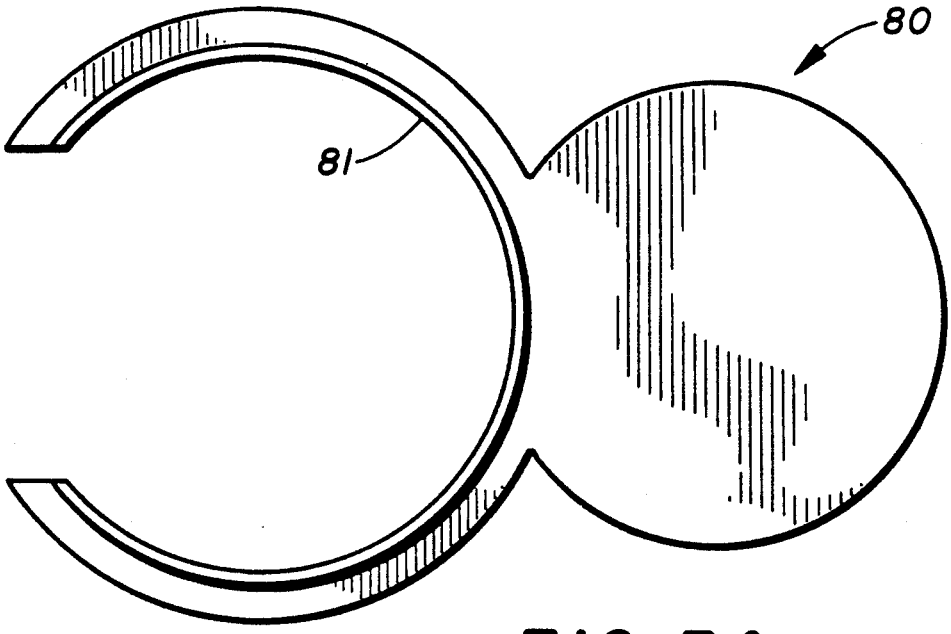
FIG. 34 is a bottom view of the elastomeric member showing the lip around the opening.

In another preferred embodiment, the retaining means 17 is a flat member formed having two adjoining circular portions in the shape of a numeral eight (FIG. 33). One portion 65 of the retaining means 17 is smaller and continuous and the other portion 66 is larger. The larger portion 66 has an opening therein. When disposed in the ratchet wrench 10, the smaller portion 65 is received in the second circular cavity 19 in which the pawl 16 is disposed and the larger portion 66 is disposed in the first circular cavity 18 in which the drive means 15 is disposed (FIG. 34). The drive tang 27 on the drive means 15 extends through the opening in the larger circular portion 66 of the retaining means 17. When the retaining means 17 is disposed in the cavities 18, 19, the pawl 16 and the drive means 15 are retained in the wrench 10. A retaining ring 67 is disposed in the annular groove 23 formed about the first cavity 18 wherein the retaining means 17 is supported on the retaining ring 67 and secured in the bottom of the head portion 12. In this manner, the retaining means 17 supports the drive means 15 and the pawl 16 and retains these components in the head portion 12 of the wrench 10 and restricts the entry of dirt into the cavities 18, 19. This embodiment also permits easy removal and replacement of the drive means 15 and pawl 16 in the event of damage or wear of these members.

Figure 35:
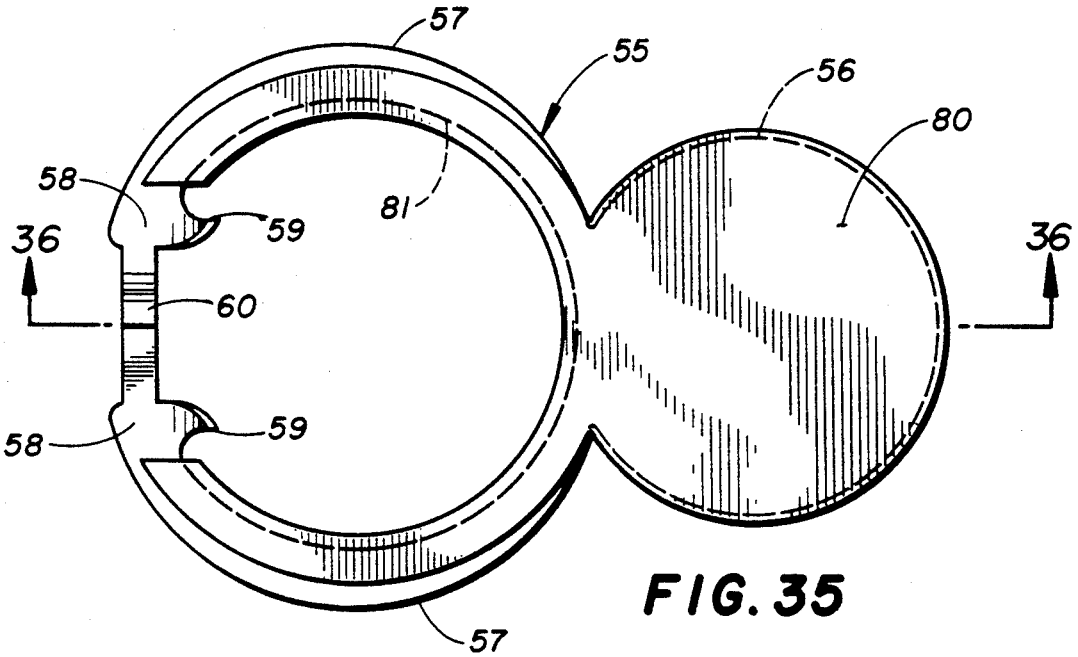
FIG. 35 is a top view of the embodiment of the retaining means of FIG. 26 showing the elastomeric member of FIG. 34 affixed thereto.
Figure 36:
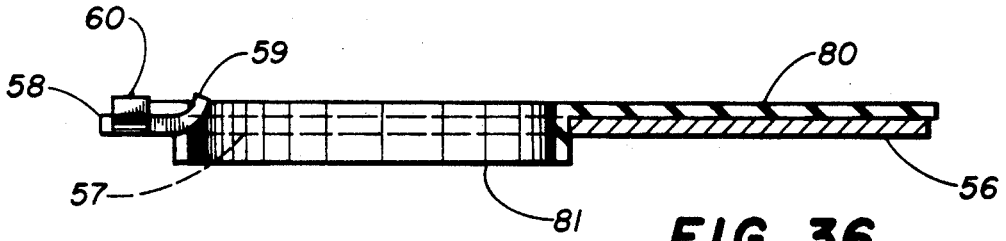
FIG. 36 is a cross section showing the elastomeric member affixed to the retaining means.
Figure 37:
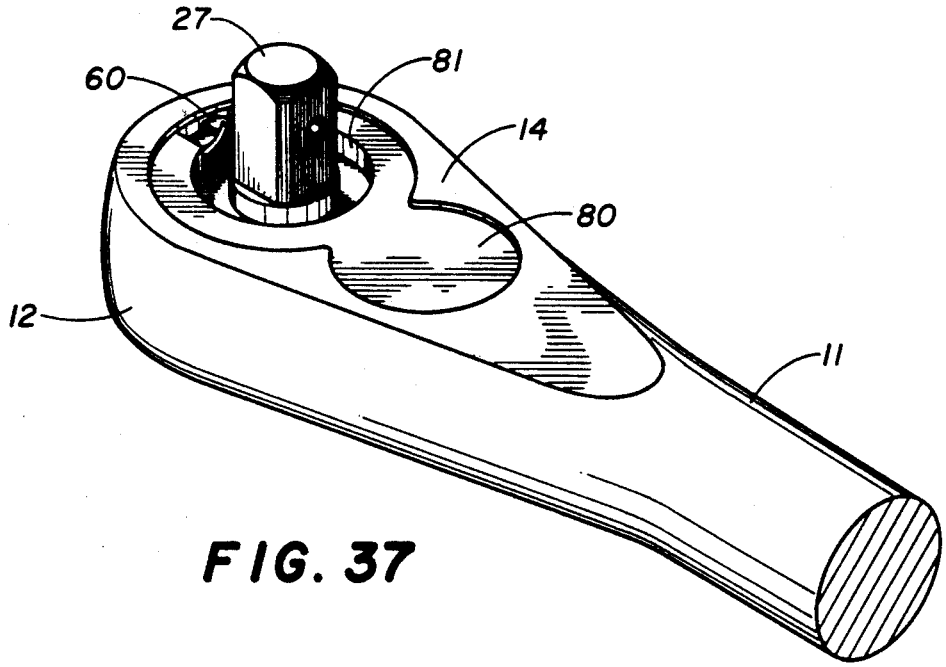
FIG. 37 is a perspective view of the wrench showing the elastomeric member affixed to the outer side of the retaining means.

In either embodiment of the retaining means 17, an elastomeric member 80 may be disposed on the surface of the retaining means 17 (FIGS. 35–37). The elastomeric member 80 is disposed on the outer surface of the retaining means 17 opposite from the drive means 15 and pawl 16. The elastomeric member 80, when so disposed, further reduces the entry of dirt, moisture and contaminants into the cavities 18, 19. The elastomeric member 80 is substantially the same configuration as the retaining means 17, that is, a numeral eight form, having an opening in the larger of the circular portions. To fur&:her restrict the entry of dirt around the opening in the one larger circular portion, a lip 81 is formed around the inner diameter of the opening in the circular portion. The lip 81 is disposed inwardly toward the retaining means 17 and acts to seal the interface between the retaining means and the shoulder 28 on the bottom of the drive means 15. The elastomeric member 80 may be adhered to the retaining means 17, as desired (FIGS. 36, 37).

Accordingly, it will be appreciated that the present invention provides a simple, relatively inexpensive ratchet wrench 10 which may be manufactured economically. The cavities 18, 19 in the head portion 12 are both formed from the bottom surface 14 of the head portion 14 reducing production costs. The opening 20 formed in the top surface 13 of the head portion 12 receives the boss 26 on the drive means 15 to permit rotational movement of the drive means 15. The one piece construction of the lever means 50 further reduces manufacturing and assembly costs. Further the non-cylindrical form of the stem 53 of the lever means 50, cooperating with the non-cylindrical bore 41 in the pawl 16, ensures rotation of the pawl 16 concomitant with rotation of the lever means 50. The multi-sided shelf 54 formed on the stem 53 of the lever means 50 cooperating with multi-sided cavity 44 in top surface 42 of the pawl 16 further ensures rotation of the pawl 16 concomitant with rotation of the lever means 50. The top surface 13 of the head portion 12 being received between the top portion 51 of the lever means 50 and the shelf 54 on the stem 53, secures the lever means 50 to the head portion 12 of the wrench 10 in a cost efficient manner which requires a minimum number of components and a minimum labor cost for assembly. The simple and easily installed retaining means 17 provides a means for retaining the drive means 15 and pawl 16 in the head portion 12 which is not only inexpensive, but allows for simple and rapid replacement and/or repair of the drive means 15 and the pawl 16. In the one embodiment, the single retaining means 17 is the only retaining component; no washers, retaining rings, screws or other means are required. The present invention has a minimum number of parts reducing component costs and assembly labor costs. The simplified design also improves quality control and provides a more reliable and serviceable item.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A reversible ratchet wrench comprising a handle portion and a head portion, the head portion having a top surface and a bottom surface, the head portion including a cylindrical drive means having spaced-apart teeth oriented vertically thereon and a partially cylindrical pawl having teeth oriented vertically thereon, the pawl having a bore opening therethrough, a lever means connected to the pawl to permit rotation of the pawl in a first direction and in a second opposite direction wherein the teeth on the pawl may selectively engage the teeth on the drive means to permit rotation of the drive means in the desired direction, the head portion having a first circular cavity and a second cavity formed therein, the circular cavities being formed from the bottom surface of the head portion, the circular cavities partially overlapping each other, each circular cavity having a respective center thereof, a respective diameter and a respective axis through the respective centers, the axes of the circular cavities being substantially parallel to each other; the drive means being disposed in the first circular cavity and the pawl being disposed in the second circular cavity from the bottom surface of the head portion, the top surface of the head portion further having therein a first circular opening and a spaced-apart second opening therein, the openings communicating with the first circular cavity and the second circular cavity respectively, the first circular opening having a diameter smaller than the diameter of the first circular cavity, the lever means having a top portion, a tab extending outwardly therefrom and a stem depending downwardly from said top portion, the stem having a shelf formed thereon, the shelf being spaced apart from the top portion of the lever means, wherein when the lever means is inserted through the second opening in the top surface of the head portion and the pawl is inserted into the head portion from the bottom of the second cavity, the stem of the lever means is received in, and cooperates with, the bore through the pawl to connect the pawl with the lever means to permit rotation of the pawl, the top surface of the head portion having a ledge formed thereon at the second opening therein, the ledge being oriented distal from the handle portion and being received between the top portion of the lever means and the shelf on the stem, wherein the lever means is secured in the second opening in the top surface of the head portion and the lever means and pawl are easily removable for repair and replacement, movement of the tab in a first direction producing movement of the pawl and permitting movement of the drive means in the first direction, movement of the tab in a second opposite direction producing movement of the pawl and permitting movement of the drive means in the second opposite direction, and unitary means for retaining the drive means and the pawl in the head portion.

2. The reversible ratchet wrench of claim 1, wherein the stem of the lever means is non-cylindrical and the vertical bore through the pawl is a cooperating non-cylindrical configuration such that rotation of the lever means produces concomitant rotation of the pawl.

3. The reversible ratchet wrench of claim 1, further comprising the drive means having an upper portion, a cylindrical boss being formed on said upper portion, the boss having a top surface, the cylindrical boss being received in the first circular opening in the top surface of the head portion.

4. The reversible ratchet wrench of claim 1, further comprising a socket releasing means disposed in the drive means wherein a socket may be easily released from the ratchet wrench.

5. The reversible ratchet wrench of claim 1, further comprising the pawl having a top surface, a multi-sided cavity being formed in the top surface of the pawl, the shelf on the stem being multi-sided, the shelf being received in and cooperating with the multi-sided cavity in the top surface of the pawl wherein movement of the lever means produces concomitant movement in the pawl.

6. A reversible ratchet wrench comprising a handle portion and a head portion, the head portion having a top surface and a bottom surface, the head portion including a substantially cylindrical drive means having teeth thereon and a partially cylindrical pawl having teeth thereon, the teeth on the pawl selectively engaging the teeth on the drive means, means for moving the drive means in a first direction and in a second, opposite direction, the head portion having a first circular cavity and a second circular cavity formed therein, the drive means being disposed in the first circular cavity and the pawl being disposed in the second circular cavity from the bottom surfaces of the head portion, the circular cavities partially overlapping each other, the first circular cavity having an internal annular groove formed thereabout, the groove being above the bottom surface of the head portion; a unitary retaining means having two circular portions, wherein the retaining means may be disposed internally in both of the circular cavities, one circular portion having resilient means associated therewith, said resilient means being received in the groove in the first circular cavity and the other circular portion being received in the second circular cavity, the retaining means being substantially parallel to and above the bottom surface of the head portion such that the drive means is retained in the head portion by the one circular portion and the pawl is retained in the head portion by the other circular portion of the retaining means, the retaining means further reducing the entry of dirt into the cavities, the retaining means being easily removable for repair and replacement of the drive means and of the pawl.

7. The reversible ratchet wrench of claim 6, wherein the one circular portion of the retaining means comprises a pair of substantially planar bifurcated arms extending outwardly from the other circular portion, the bifurcated arms forming a substantially circular opening therebetween, the bifurcated arms being received in the groove in the first circular cavity, the drive means having a drive tang formed on the drive means, the drive tang being received in the circular opening formed by the bifurcated arms.

8. The reversible ratchet wrench of claim 7, further having means on the bifurcated arcuate arms of the retaining means to permit said arms to be moved towards one another to permit the arms to be received in, and removed from, the annular groove.

9. The reversible ratchet wrench of claim 8, wherein the bifurcated arcuate arms of the retaining means each have an end, each end having an inwardly-shaped hook thereon wherein the hooks may be grasped and squeezed together.

10. The reversible ratchet wrench of claim 9, further having the end of one arm having a bend thereon so that, when squeezed together, the end of the one arm extends over the end of the other arm.

11. The reversible ratchet wrench cf claim 8, wherein the bifurcated arcuate arms of the retaining means each have an end, each end being bent at an angle of approximately 90° perpendicularly from each respective arm, wherein the bent ends may be grasped and squeezed together.

12. The reversible ratchet wrench cf claim 8, wherein the bifurcated arms of the retaining means each have an end, the ends being in a same plane adjacent to one another, a kerf being formed in each arm, the kerfs being directly opposed to one another such that a flat blade may be placed in the kerfs and when the flat blade is twisted, the arms move towards one another.

13. The reversible ratchet wrench of claim 7, further comprising an elastomeric member disposed on a surface of the retaining means opposite from the pawl and drive means, the elastomeric member being substantially the same configuration as the retaining means and further having a lip extending around the substantially circular opening wherein dirt, moisture and contaminants are prevented from entering into the cavities in the head portion.

14. A unitary retaining means for retaining members in a pair of adjoining partially overlapping circular cavities, the retaining means comprising a circular portion and a pair of bifurcated arms extending outwardly from the circular portion, the bifurcated arms forming a substantially circular opening therebetween wherein the retaining means may be disposed in the adjoining cavities, the bifurcated arms being received in the one cavity and the circular portion being received in the second cavity, means for holding the retaining means in the cavities wherein the retaining means retains members in said cavities.

15. The retaining means of claim 14, wherein the bifurcated arms have an outer surface and a circular inner surface, the outer surface being nonconcentric with the circular inner surface.

16. The retaining means of claim 14, further comprising an internal annular groove formed about the one cavity, the bifurcated arms being received in the annular groove.

17. A retaining means for retaining members in a pair of adjoining partially overlapping circular cavities, the retaining means comprising two circular portions in the form of a numeral eight, the one portion having a substantially circular opening therein and the second portion being a continuous portion, the one portion having an opening therein being received in the one cavity and the second continuous portion being received in the second cavity, wherein the retaining means may be disposed in the adjoining cavities, means for holding the retaining means in the cavities wherein the retaining means retains members in said cavities.

18. The retaining means of claim 17 further comprising an internal annular groove formed about the one cavity, a retaining ring disposed in the annular groove wherein the retaining means is supported on the retaining ring and is held in the cavities and retaining members in said cavities.

19. A reversible ratchet wrench comprising a handle portion and a head portion, the head portion having a top surface and a bottom surface, the head portion including a cylindrical drive means having spaced-apart teeth oriented vertically thereon and a partially cylindrical pawl having teeth oriented vertically thereon, the pawl having a bore opening therethrough, a lever means connected to the pawl to permit rotation of the pawl in a first direction and in a second opposite direction wherein the teeth on the pawl may selectively engage the teeth on the drive means to permit rotation of the drive means in the desired direction, the head portion having a first circular cavity and a second cavity formed therein, the circular cavities being formed from the bottom surface of the head portion, the circular cavities partially overlapping each other, each circular cavity having a respective center thereof, a respective diameter and a respective axis through the respective centers, the axes of the circular cavities being substantially parallel to each other; the drive means being disposed in the first circular cavity and the pawl being disposed in the second circular cavity from the bottom surface of the head portion, the top surface of the head portion further having therein a first circular opening and a spaced-apart second opening therein, the openings communicating with the first circular cavity and the second circular cavity respectively, the first circular opening having a diameter smaller than the diameter of the first circular cavity, the lever means having a top portion, a tab extending outwardly therefrom and a stem depending downwardly from said top portion, the stem having a shelf formed thereon, the shelf being spaced apart from the top portion of the lever means, wherein when the lever means is inserted through the second opening in the top surface of the head portion and the pawl is inserted into the head portion from the bottom of the second cavity, the stem of the lever means is received in and cooperates with, the vertical bore through the pawl to connect the pawl with the lever means to permit rotation of the pawl, the top surface of the head portion having a ledge formed thereon at the second opening therein, the ledge being oriented distal from the handle portion and being received between the top portion of the lever means and the shelf on the stem, wherein the lever means is secured in the second opening in the top surface of the head portion and the lever means and pawl are easily removable for repair and replacement; the pawl having a top surface, a multi-sided cavity being formed in the top surface of the pawl, the shelf on the stem being multi-sided, the shelf being received in and cooperating with the multi-sided cavity in the top surface of the pawl; movement of the tab in a first direction producing movement of the pawl and permitting movement of the drive means in the first direction, movement of the tab is a second opposite direction producing movement of the pawl and permitting movement of the drive means in the second opposite direction; the first circular cavity having an internal annular groove formed thereabout, the groove being above the bottom surface of the head portion; a unitary retaining means having two circular portions, wherein the retaining means may be disposed internally in both of the circular cavities, one circular portion having resilient means associated therewith, said resilient means being received in the groove in the first circular cavity and the other circular portion being received in the second circular cavity, the retaining means being substantially parallel to and above the bottom surface of the head portion such that the drive means is retained in the head portion by the one circular portion and the pawl is retained in the head portion by the other circular portion of the retaining means, the retaining means further preventing the entry of dirt into the cavities, the retaining means being easily removable for repair and replacement of the drive means and of the pawl.

20. The reversible ratchet wrench of claim 19, wherein the one circular portion of the retaining means comprises a pair of bifurcated arms extending outwardly from the other circular portion, the bifurcated arms forming a substantially circular opening therebetween, the bifurcated arms being received in the groove in the first circular cavity, the drive means having a drive tang formed on the drive means, the drive tang being received in the circular opening formed by the bifurcated arms.

21. A reversible ratchet wrench comprising a handle portion and a head portion, the head portion having a top surface and a bottom surface, the head portion including a cylindrical drive means having spaced-apart teeth oriented vertically thereon and a partially cylindrical pawl having teeth oriented vertically thereon, the pawl having a vertical bore therethrough, a lever means connected to the pawl to permit rotation of the pawl in a first direction and in a second opposite direction wherein the teeth on the pawl may selectively engage the teeth on the drive means to permit rotation of the drive means in the desired direction, the head portion having a first circular cavity and a second cavity formed therein, the circular cavities being formed from the bottom surface of the head portion, the circular cavities partially overlapping each other, each circular cavity having a respective center thereof, a respective diameter and a respective axis through the respective centers, the axes of the circular cavities being substantially parallel to each other, the drive means being disposed in the first circular cavity and the pawl being disposed in the second circular cavity from the bottom surface of the head portion the top surface of the head portion further having therein a first circular opening and a spaced-apart second opening therein, the openings communicating with the first circular cavity and the second circular cavity respectively, the first circular opening having a diameter smaller than the diameter of the first circular cavity, the lever means having a top portion, a tab extending outwardly therefrom and a stem depending downwardly from the top portion, the stem of the lever means being inserted through the second opening in the top surface of the head portion, the stem being received in the vertical bore in the pawl; means for connecting the lever means to the pawl wherein movement of the tab in a first direction produces movement of the pawl and permits movement of the drive means in the first direction; and movement of the tab in a second opposite direction produces movement of the pawl and permits movement of the drive means in the second opposite direction.

22. The reversible ratchet wrench of claim 21, wherein the means for connecting the lever means to the pawl comprises the stem of the lever means being non-cylindrical and the bore through the pawl being a cooperating non-cylindrical configuration such that rotation of the lever means produces concomitant rotation of the pawl.

23. The reversible ratchet wrench of claim 21, wherein the stem depending from the lever means has a shelf formed thereon, the shelf being multi-sided, the pawl having a top surface, a multi-sided cavity being formed in the top surface of the pawl, the multi-sided cavity cooperating with the multi-sided shelf wherein the shelf may be received in the cavity and provide means to connect the lever means to the pawl such that rotation of the lever means produces concomitant rotation of the pawl.

24. In a ratchet wrench, the combination of a handle including a head portion having top and bottom surfaces and further having a pawl cavity communicating with the bottom surface of the head, the top surface of the head having an opening formed therein communicating with the pawl cavity and defining a rearwardly-facing ledge, a reversing lever including a tab and a stem and further including an intermediate portion provided with a recess therein, the reversing lever being inserted through the opening in the top surface of the head, such that the stem of the reversing lever is received within the pawl cavity, and such that the reversing lever may thereafter be moved forwardly of the pawl cavity whereby the ledge in the head is received within the recess in the reversing lever, and whereby movement of the reversing lever axially of the pawl cavity is restricted, a pawl having a bore formed therein, the pawl being received within the pawl cavity from the bottom surface of the head, the pawl having a bore formed therein, and the stem of the reversing lever being received within the bore in the pawl and secured thereto, thereby retaining the pawl and reversing lever.

25. A reversible ratchet wrench comprising a handle portion and a head portion, the head portion having a top surface and a bottom surface, the head portion including a cylindrical drive means having spaced-apart teeth oriented vertically thereon and a partially cylindrical pawl having teeth oriented vertically thereon, the pawl having a vertical bore therein, wherein the teeth on the pawl may selectively engage the teeth on the drive means to permit rotation of the drive means in a desired direction, the head portion having a first circular cavity and a second circular cavity formed therein, the circular cavities being formed from the bottom surface of the head portion, the circular cavities partially overlapping each other, the top surface of the head portion having an opening formed therein, the opening communicating with the second circular cavity, a ledge being formed on the opening, the ledge being oriented distal from the handle portion; a lever means having a top portion, a tab extending outwardly therefrom and a stem depending downwardly from the top portion, the stem having a shelf formed thereon, the shelf being spaced-apart from the top portion of the lever means, wherein when the lever means is disposed in the opening in the top surface of the head portion, the ledge is received between the top portion of the lever means and the shelf on the stem and the lever means is secured in the wrench, wherein, when the pawl is disposed in the second circular cavity and the drive means is disposed in the first circular cavity from the bottom surface of the head portion, the stem of the lever means is received in, and cooperates with the bore in the pawl, wherein movement of the tab on the lever means in a first direction produces movement of the pawl and permits movement of the drive means in the first direction; and movement of the tab in a second opposite direction produces movement of the pawl and permits movement of the drive means in the second opposite direction, and further wherein removal of the pawl for servicing and repairs is simple and inexpensive.

26. A reversible ratchet wrench comprising a handle portion and a head portion, the head portion having a top surface and a bottom surface, the head portion having a circular cavity therein formed from the bottom surface of the head portion, the top surface of the head portion having an opening therein, the opening communicating with the circular cavity, a ledge being formed on the opening, a lever means having a top portion and a stem depending from the top portion, means on the lever means to engage the ledge wherein the lever means may be secured to the head portion, a pawl having a vertical bore therein, the pawl being disposed in the circular cavity from the bottom surface of the head portion, the stem portion of the lever means being keyed to and cooperating with the bore in the pawl, wherein movement of the lever means in a first direction produces movement of the pawl in the first direction and movement of the lever means in a second opposite direction produces movement of the pawl in the second direction.

27. In a ratchet wrench, the combination of a head having a first opening formed therein which is accessible from above the wrench and further having a second opening formed therein which is accessible from below the wrench, the first and second openings communicating therebetween and forming a cavity in the head, the first opening being eccentrically disposed with respect to the second opening, a pawl disposed in the cavity in the head from below the wrench, the pawl having a bore formed therein, a reversing lever having a stem received through the first opening and into the bore in the pawl, means for keying the pawl and reversing lever for conjoint pivotal movement in unison, the reversing lever having a forwardly-projecting notch means formed therein, the head having a rearwardly-projecting ledge means received in the notch means on the reversing lever and removable means for retaining the pawl in the second opening in the head for facilitating convenient assembly and disassembly of the pawl and the reversing lever for service and repair.

* * * * *